US008856999B2

(12) United States Patent
Sciuto

(10) Patent No.: US 8,856,999 B2
(45) Date of Patent: Oct. 14, 2014

(54) MACHINE FOR SCRATCHING THE REMOVABLE PAINT OFF THE SCRATCH TICKETS

(75) Inventor: Giovanni Sciuto, Macerata (IT)

(73) Assignee: Everex s.r.l., Florence (IT)

( * ) Notice: Subject to any disclaimer, the term of this patent is extended or adjusted under 35 U.S.C. 154(b) by 372 days.

(21) Appl. No.: 13/380,716

(22) PCT Filed: Jun. 24, 2010

(86) PCT No.: PCT/IT2010/000280

§ 371 (c)(1),
(2), (4) Date: Dec. 23, 2011

(87) PCT Pub. No.: WO2010/150295

PCT Pub. Date: Dec. 29, 2010

(65) Prior Publication Data

US 2012/0102666 A1 May 3, 2012

(30) Foreign Application Priority Data

Jun. 25, 2009 (IT) ..... MC2009A0153

(51) Int. Cl.
*B23D 79/02* (2006.01)
*A63F 3/06* (2006.01)

(52) U.S. Cl.
CPC .. *A63F 3/068* (2013.01); *A63F 3/06* (2013.01)
USPC ..... 15/93.4; 15/93.1

(58) Field of Classification Search
CPC ..... A63F 3/068; B23D 79/02
USPC ..... 15/93.4, 93.1, 97.1, 102, 77, 88.2, 88.3; 30/169, 172
See application file for complete search history.

(56) References Cited

U.S. PATENT DOCUMENTS

| | | | | |
|---|---|---|---|---|
| 3,440,675 | A | | 4/1969 | Yeaman |
| 4,765,842 | A | | 8/1988 | Sanders et al. |
| 5,355,543 | A | | 10/1994 | Cameron et al. |
| 5,402,549 | A | | 4/1995 | Forrest |
| 5,417,424 | A | | 5/1995 | Snowden et al. |
| 5,907,882 | A | * | 6/1999 | Tyree ..... 15/77 |
| 6,155,491 | A | | 12/2000 | Dueker et al. |

(Continued)

FOREIGN PATENT DOCUMENTS

| | | | |
|---|---|---|---|
| EP | 0824944 | A1 | 2/1998 |
| FR | 2756496 | A1 | 6/1998 |
| WO | 2006116501 | A1 | 11/2006 |

OTHER PUBLICATIONS

Computer generated English translation of EP 0824944 A1, Hubert, Feb. 1998.*

(Continued)

*Primary Examiner* — Laura C Guidotti
(74) *Attorney, Agent, or Firm* — Griffin & Szipl, P.C.

(57) ABSTRACT

The machine is made up of an upper scraping device R (FIG. 7) and a lower contrast and drawing device T (FIG. 7), both independent even in motorization, and connected to each other by respective side frames FI and FS (FIG. 7) through a contrast screw and spring system 2,8 (FIG. 1); wherein both the scraping device and the contrast and drawing device are simultaneously operated, wherein when the ticket passes between them, the simultaneous interaction of the two devices R and T clean the ticket 20 of its removable paint.

16 Claims, 7 Drawing Sheets

(56) References Cited

U.S. PATENT DOCUMENTS

| | | | | |
|---|---|---|---|---|
| 8,192,268 | B1 | 6/2012 | Karpe | |
| 2004/0162131 | A1 | 8/2004 | Shuster | |
| 2007/0037499 | A1 | 2/2007 | Burbridge | |
| 2013/0056157 | A1* | 3/2013 | Laghi | 156/760 |

OTHER PUBLICATIONS

International Search Report issued in corresponding application PCT/IT2010/000280, completed Oct. 13, 2010 and mailed Oct. 21, 2010.

* cited by examiner

MACHINE FOR SCRATCHING THE REMOVABLE PAINT OFF THE SCRATCH TICKETS

This is a National Phase Application in the United States of International Patent Application No. PCT/IT2010/000280 filed Jun. 24, 2010, which claims priority on Italian Patent Application No. MC2009A000153, filed Jun. 25, 2009. The entire disclosures of the above patent applications are hereby incorporated by reference.

FIELD OF THE INVENTION

The present invention relates to a machine for mechanically scraping the removable paint film off of the scratch tickets.

BACKGROUND OF THE INVENTION

As known, the removal of the paint film, which covers the numbers of scratch tickets, is manually done using items such as coins, or other kind of appropriate elements for the scraping. The aim of the present invention is to provide an automatic and fast mechanical element, which can clean up the ticket, revealing all that is hidden under the paint film to be scratched off, without causing damage to the underlying graphics.

SUMMARY OF THE INVENTION

The system, in accordance with the present invention, is made up of an upper scraping device R (FIG. 7) and a lower contrast and drawing device T (FIG. 7), both independent even in motorization, connected to each other by means of respective side frames FI and FS (FIG. 7) through a contrast screw and spring system 2,8 (FIG. 1); wherein when both the devices are simultaneously operated, the ticket passes between them, and the simultaneous interaction of the two devices R and T clean the ticket 20 of its removable paint.

In accordance with a first embodiment of the present invention, a machine for scratching off the removable paint of tickets (20), such as scratch tickets or the like, is provided that comprises a scraping device (R) and a contrast and drawing device (T), wherein the scraping device (R) comprises at least one first scraping roll (RA1) and the contrast and drawing device (T) comprises at least one contrast and drawing roll (RB1), wherein the at least one first scraping roll (RA1) and the first contrast and drawing roll (RB1) are provided with at least one motorization so as to be both driven, wherein the at least one first scraping roll (RA1) and the at least one first contrast and drawing roll (RB1) are opposite and spaced between each other, so that the ticket (20) passes between them and, due to the contemporaneous action of the at least one scraping roll (A1) and the at least one drawing roll (RB1), the removable paint of the ticket (20) is scraped off. In accordance with a second embodiment of the present invention, the first embodiment is modified so that the scraping device (R) includes a first motorization (MR), which rotates the at least one scraping roll (RA1) and the contrast and drawing device (T) comprises a second motorization (MT), which rotates the at least one drawing roll (RB1).

In accordance with a third embodiment of the present invention, the first embodiment or the second embodiment is further modified so that the scraping device (R) comprises at least a first and a second scraping roll (RA1,RA2) and the contrast and drawing device (T) comprises at least a first and a second contrast and drawing roll (RB1, RB2), wherein the at least one first scraping roll (RA1) is opposite and distanced from the first contrast and drawing roll (RB1) and the at least one second scraping roll (RA2) is opposite and distanced from the at least one second contrast and drawing roll (RB2),) wherein the ticket (20) passes between the at least two scraping rolls (RA1, RA2) and the at least two contrast and drawing rolls (RB1, RB2) so that, due to the action of both scraping rolls (RA1, RA2), the removable paint of the ticket (20) is scraped off. In accordance with a fourth embodiment of the present invention, the third embodiment is further modified so that the scraping device (R) contains a pair of scraping rolls (RA1,RA2) with a respective motorization and the contrast and drawing device (T) contains a pair of contrast and drawing rolls (RB1, RB2) with a respective motorization, wherein the ticket (20) passes between the scraping device (R) and the contrast and drawing roll (T) so that due to their contemporaneous action they clean the ticket of the removable paint. In accordance with a fifth embodiment of the present invention, the third embodiment or the fourth embodiment are further modified so that the at least two scraping rolls (RA1, RA2) comprise a plurality of toothed rollers (r2) spaced between each other and attached respectively to a shaft (A1, A2). In accordance with a sixth embodiment of the present invention, the fifth embodiment is further modified so that the rollers (r2) are metallic and completely made of a single solid body. In accordance with a seventh embodiment of the present invention, the fifth embodiment or the sixth embodiment are further modified so that the rollers (r2) are arranged in parallel and subsequent rows.

In accordance with an eighth embodiment of the present invention, the fifth embodiment, the sixth embodiment and the seventh embodiment, are further modified so that the toothed scraping rollers (r2) of the first scraping roll (RA1) are arranged in a complementary way with the rollers (r2) of the second scraping roll (RA2), so that the rollers (r2) of the second scraping roll (RA1) remove the paint not removed from the rollers (r2) of the first scraping roll (RA2) and vice versa, so as to completely scrape the paint off the ticket (20). In accordance with a ninth embodiment of the present invention, the third embodiment or the fourth embodiment is further modified so that the at least two contrast and drawing rolls (RB1, RB2) comprise a plurality of flat rollers (r1) spaced between each other and attached to a shaft (B1, B2). In accordance with a tenth embodiment of the present invention, the ninth embodiment is further modified so that the rollers (r1) of the contrast and drawing rolls (RB1, RB2) are made of a soft material. In accordance with a tenth embodiment of the present invention, the ninth embodiment or the tenth embodiment is further modified so that the arrangement of the contrast and drawing rollers (r1) is a specular copy of the arrangement of the scraping toothed rollers (r2).

In accordance with an eleventh embodiment of the present invention, the first embodiment, the second embodiment, the third embodiment, the fourth embodiment, the fifth embodiment, the sixth embodiment, the seventh embodiment, the eighth embodiment, the ninth embodiment, and the tenth embodiment are further modified so that the scraping device (R) and the contrast and drawing device (T) are connected by means of an adjustable contrast screw-spring mechanism (2.8), which enables the adjustment of the scraping device (R) with respect to the contrast and drawing device (T). In accordance with a twelfth embodiment of the present invention, the third embodiment is further modified so that it comprises two independent devices, namely, a scraping device (R) containing a pair of scraping rolls (RA1,RA2) with a respective motorization and a contrast and drawing device (T) containing a pair of contrast and drawing rolls (RB1, RB2) with a respective motorization, joined together by means of an adjustable contrast screw-spring mechanism (2.8), wherein the ticket passes between the two devices (R,T), which due to their contemporaneous action clean the ticket of the removable paint. In accordance with a thirteenth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment, the eleventh embodiment, and the twelfth embodiment are further modified so that it comprises control means (L1, L2) of the motorization (MR) of the at least one scraping roll (RA1, RA2), wherein the control means (L1, L2) is able to reverse the direction of rotation of the scraping rolls (RA1, RA2). In accordance with a fourteenth embodiment of the present invention, the thirteenth embodiment is further modified so that the control means (L1, L2) reverse the direction of rotation (M3) of the scraping rolls (RA1, RA2) with respect to the starting direction (M2) of rotation when the ticket passes through. In accordance with a fifteenth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment, the eleventh embodiment, the twelfth embodiment, the thirteenth embodiment, and the fourteenth embodiment are further modified so that the scraping device (R) and the contrast and drawing device (T) have a reversed position from that described and shown above, that is, the scraping device (R) is positioned underneath the contrast and drawing device (T).

BRIEF DESCRIPTION OF THE DRAWINGS (FIGURE LIST)

An embodiment of invention will be described as follows, simply by way of example, with reference to the following drawings wherein.

DETAILED DESCRIPTION OF THE INVENTION (INTRODUCTION)

Figure 1:
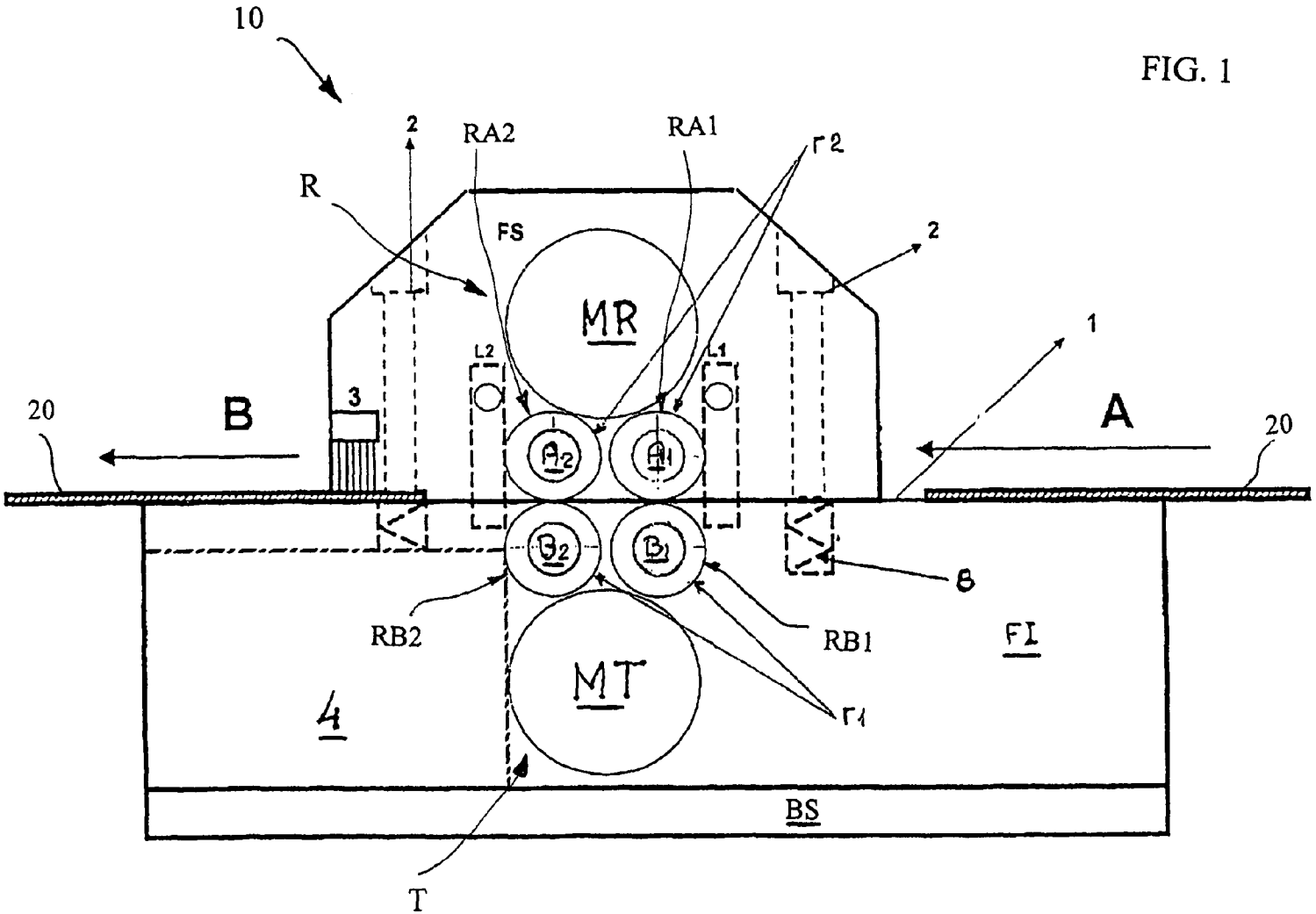
FIG. 1 is a longitudinal view of a machine according to the present invention.

In the description, the following symbols will be used:

10 designates a machine for scraping the removable paint film

FI designates two side frames of the machine 10

FS designates two side frames of the machine 10

BS designates a base of the machine 10

20 designates a ticket to be scraped

20A designates an area of the ticket 20 to be cleaned

A designates an entry side for the ticket

B designates an exit side for the ticket

1 designates an entry support plane of the ticket

2 and 8 respectively designate a contrast screw and spring

3 designates a brush

4 designates an extractable storage drawer for the removed paint

6 designates an exit comb-shaped support plane of the ticket for the discharge of removed paint R designates a scraping device RA1 and RA2 designate a first and a second scraping roll of the scraping device R A1 and A2 designate shafts, respectively, of the first and the second scraping roll RA1 and RA2 r2 designates contrast and drawing rollers of the two scraping rolls RA1 and RA2

MR designates a scraping motor for driving the two scraping shafts A1 and A2

IMR designates gear attached to the scraping motor MR

IAR designates two gears attached respectively to the two scraping shafts A1 and A2

T designates a contrast and drawing device

RB1 and RB2 designate a first and second contrast and drawing roll of the contrast and drawing device T B1 and B2 designate shafts respectively of the first and second contrast and drawing roll RB1 and RB2 r1 designates contrast and drawing rollers of the two contrast and drawing rolls RB1 and RB2

MT designates a contrast and drawing motor for driving the two contrast and drawing shafts B1 and B2

IMT designates gear attached to the contrast and drawing motor MT

IAT designates two gears attached to the two contrast and drawing shafts B1 and B2 d1 designates a distance between the scraping rollers r2 and the contrast and drawing rollers r1

M1 designates a direction of the initial rotation of the contrast and drawing rolls RB1 and RB2

M2 designates a direction of the initial rotation of the scraping rolls RA1, RA2

M3 designates a direction of the final rotation of the scraping rolls RA1, RA2

L1 designates a first microswitch

L2 designates a second microswitch.

For the sake of clarity, we call scraping rolls RA1 and RA2 a multiple series of metallic rollers r2 (FIG. 3), mounted on two mechanical shafts A1 and A2 (FIG. 3), in an alternate way and attached to the same; and we call contrast and drawing rolls RB1 and RB2 a multiple series of soft rollers r1 (FIG. 4) mounted on two mechanical shafts B1 and B2 (FIG. 4), and, in an alternated way and attached to the same; we refer to them simply as rolls.

DETAILED DESCRIPTION OF THE INVENTION (Embodiments)

Figure 5:
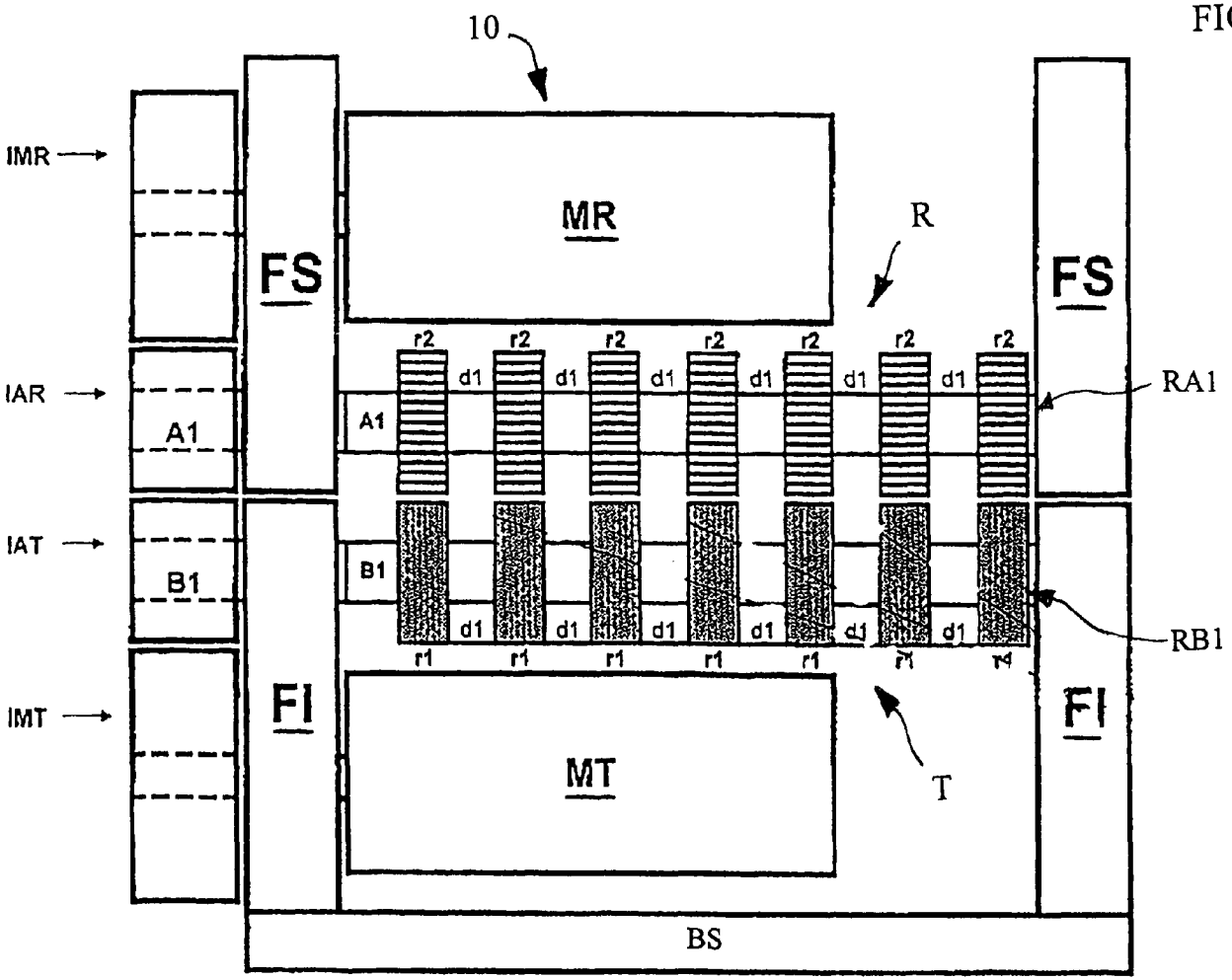
FIG. 5 is a cross section of the machine of FIG. 1.
Figure 7:
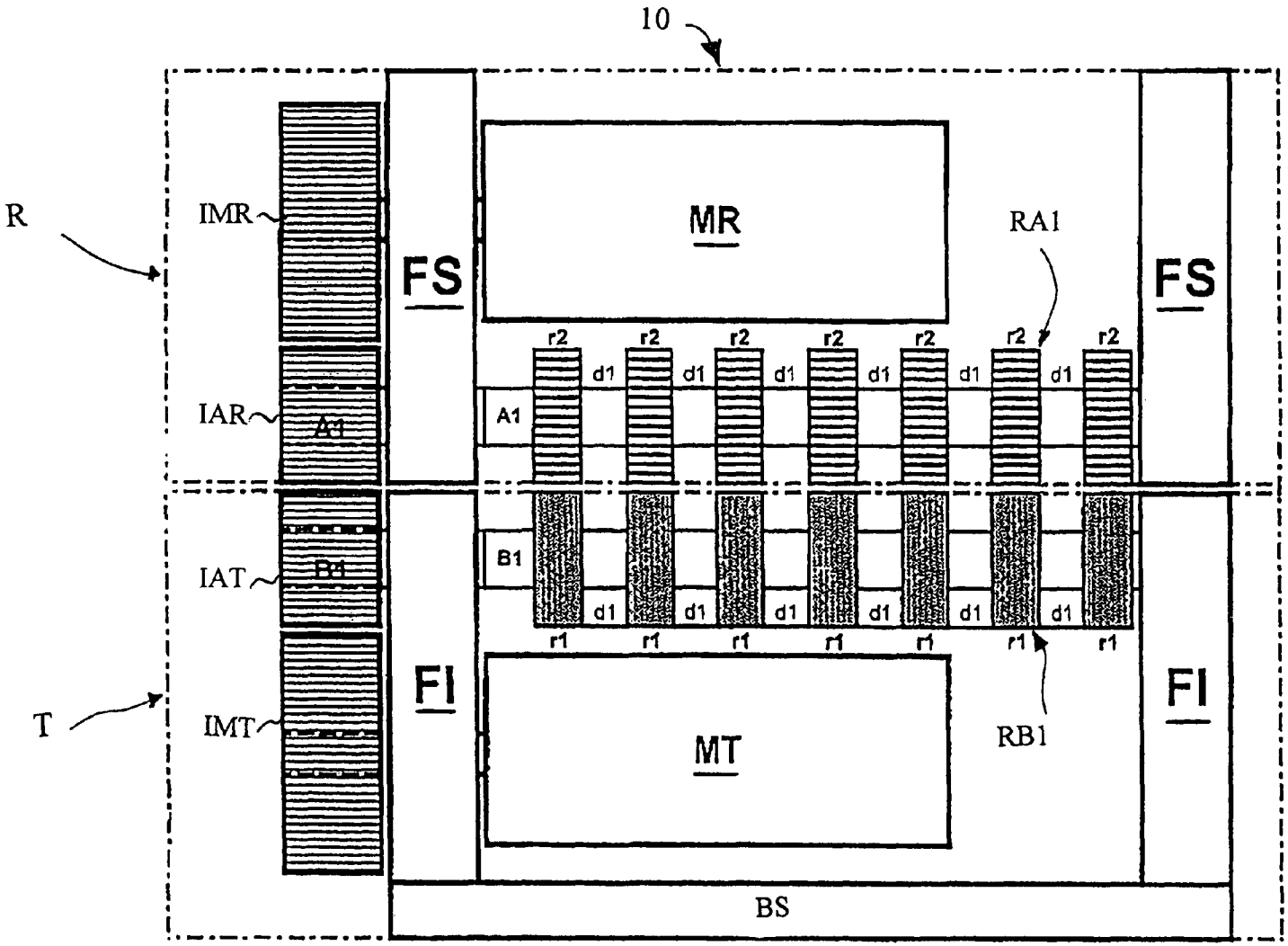
FIG. 7 is a cross section of the machine of FIG. 1.

FIGS. 1, 5 and 7 show a machine 10 for removing, or scraping off, the paint that covers tickets 20, such as scratch tickets or the like. In the following description, merely for illustrative purposes, we will refer to the tickets of the above-mentioned type, but with no limitation on the scope of the invention.

The machine 10 includes a base BS, two lower side frames FI and two upper side frames FS. From FIGS. 5, 6 and 7, we note that a contrast and drawing device T of the ticket 20 is interposed between the lower side frames FI. The contrast and drawing device T comprises a first and a second contrast and drawing roll RB1 and RB2, each respectively includes a first and a second contrast and drawing shaft B1 and B2, wherein each has a plurality of contrast and drawing rollers r1 spaced between each other by a distance d1. Each contrast and drawing shaft B1 and B2 is attached to a first gear IAT, which both engage with a second gear IMT attached to a drawing motor MT.

A scraping device R of the ticket 20 is interposed between the two upper side frames FS. The scraping device R includes a first and a second scraping roll RA1 and RA2, wherein each scraping roll comprises, respectively, a first and a second scraping shaft A1 and A2, wherein each scraping shaft has a plurality of rollers r2 spaced between each other by distance d1. Each scraping shaft A1 and A2 is attached to a first gear IAR, which both engage with a second gear IMR attached to a scraping motor MR.

Figure 2:
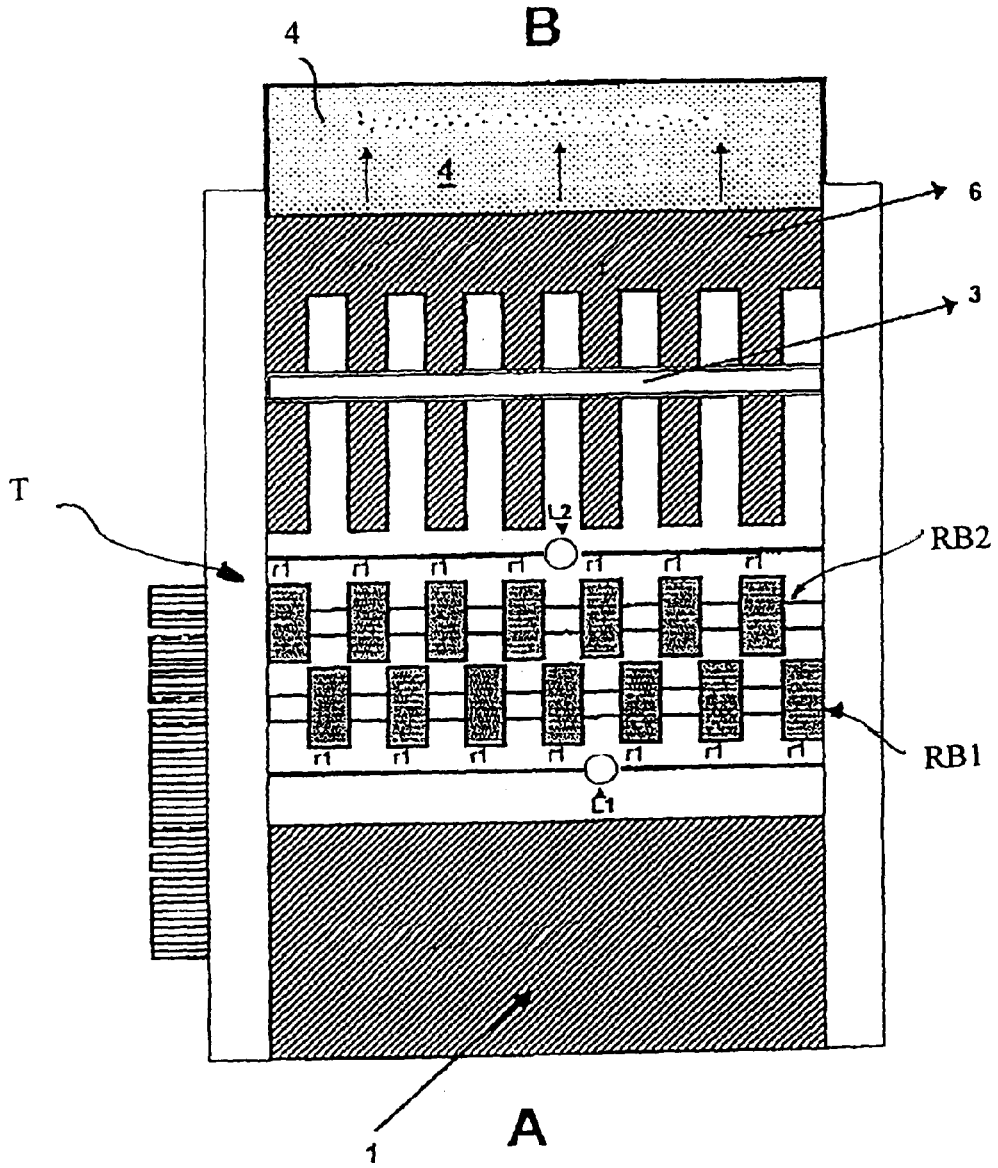
FIG. 2 is a top view of the machine of FIG. 1, wherein the upper part of the machine has been removed.
Figure 4:
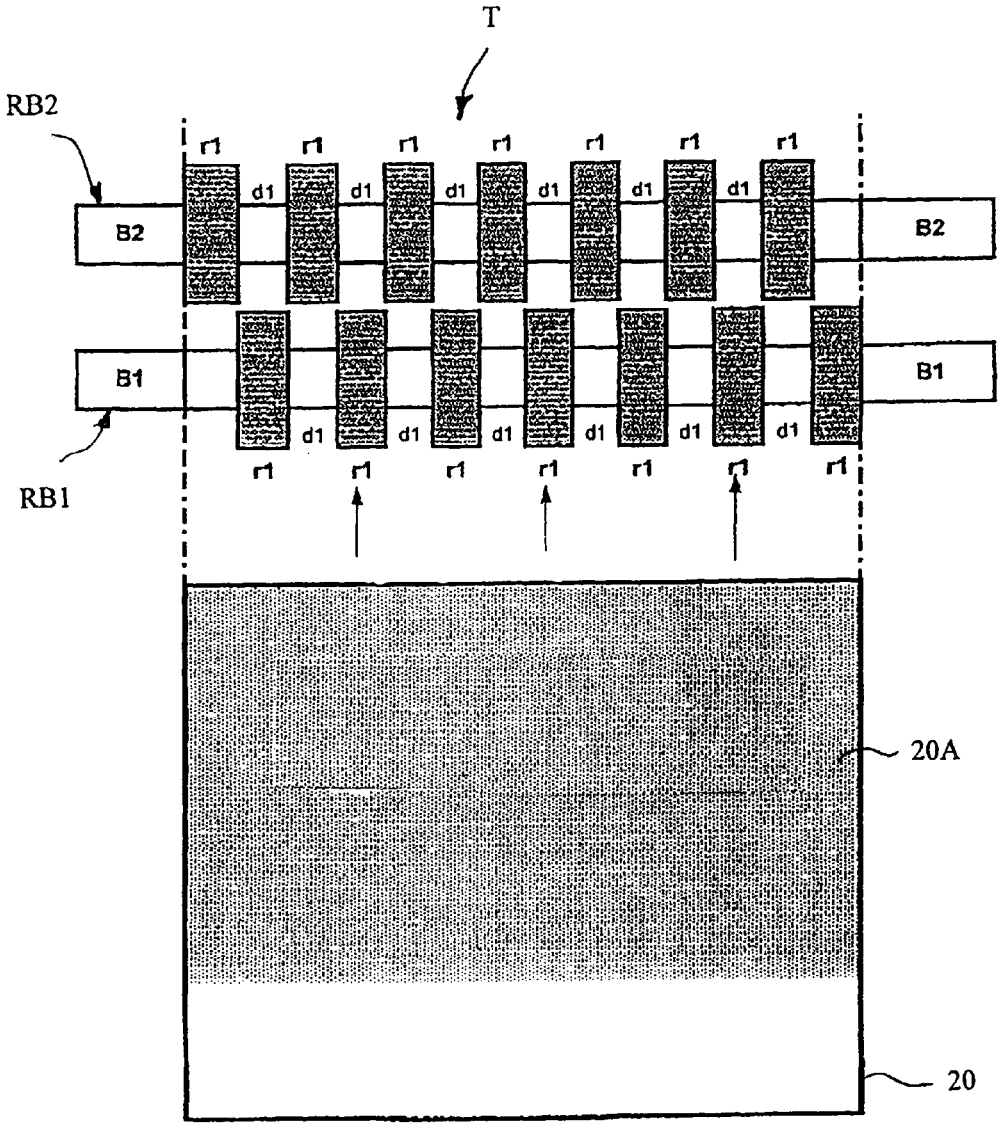
FIG. 4 is a partial top view of the machine of FIG. 1, wherein the upper part of the machine has been removed.

From FIGS. 2 and 4, it can be noted that the rollers r1, arranged on the first contrast and drawing shaft B1, are complementary with respect to the rollers r1 arranged on the second contrast and drawing shaft B2. More precisely, the rollers r1 of the first contrast and drawing shaft B1 are in front of the gaps that separate the rollers r1 of the second contrast and drawing shaft B2 and their width are equal, or nearly equal, to the distance d1 that separates the rollers r1 arranged on the second contrast and drawing shaft B2.

Similarly, the rollers r1 of the second contrast and drawing shaft B2 are in front of the gaps that separate the rollers r1 of the first contrast and drawing shaft B1, and their width are equal or nearly equal to the distance d1 that separates the rollers r1 arranged on the first contrast and drawing shaft B1. Similarly, from FIG. 3, it can be noted that the rollers r2, arranged on the first scraping shaft A1, are complementary with respect to the rollers r2 arranged on the second scraping shaft A2. More precisely, the rollers r2 of the first scraping shaft A1 are in front of the gaps that separate the rollers r2 of the second scraping shaft A2, and their width are equal to or greater than the distance d1 that separate the rollers r2 arranged on the second scraping shaft A2. Similarly, the rollers r2 of the second scraping shaft A2 are in front of the gaps that separate the rollers r2 of the first scraping shaft A1, and their width are equal or nearly equal to the distance d1 that separates the rollers r2 arranged on the first scraping shaft A1.

Figure 6:
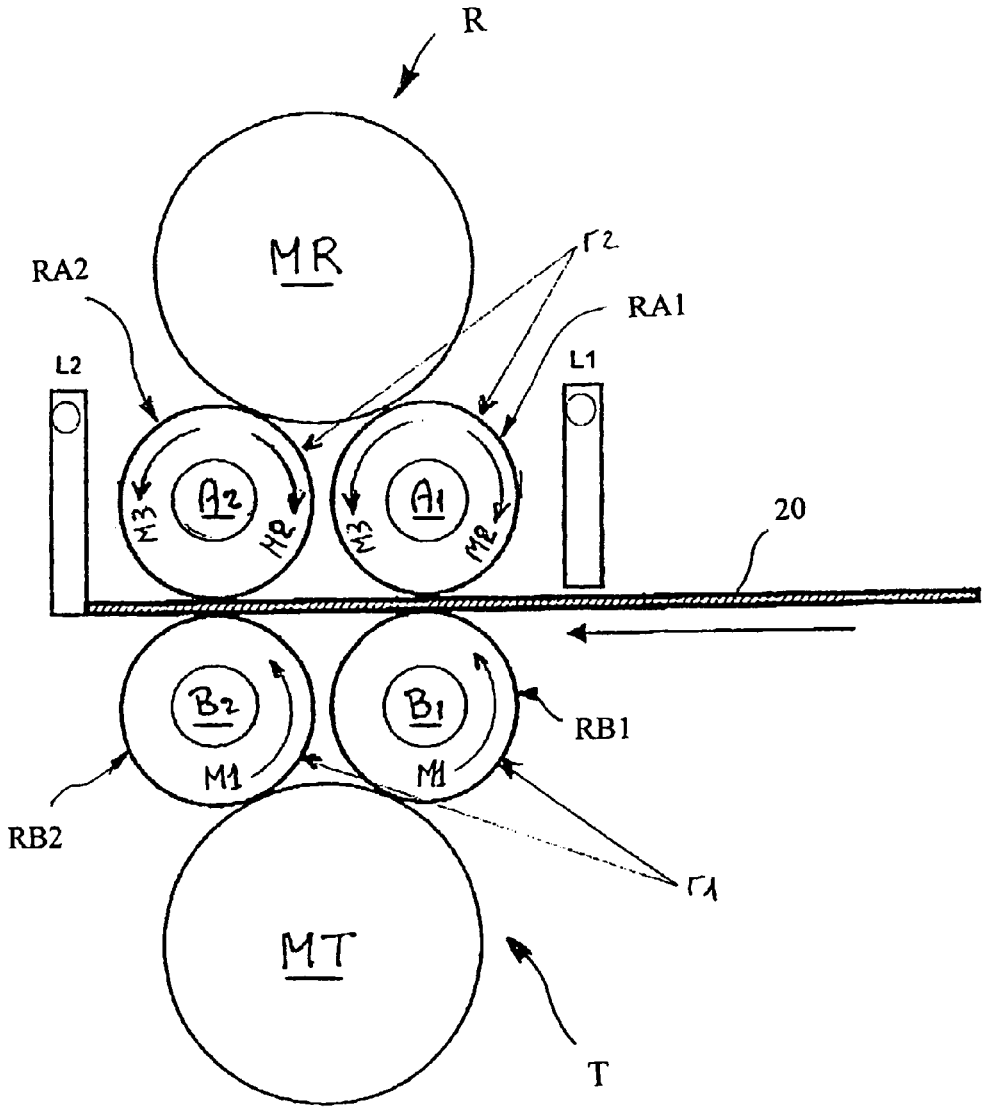
FIG. 6 is a partial longitudinal section of the machine of FIG. 1.

From FIG. 6, it can be noted that the first contrast and drawing roll RB1 is opposite to the first scraping roll RA1 to form a first pair of rolls between which the scratch ticket passes. The second contrast and drawing roll RB2 is opposite to the scraping roll RA2 to form a second pair of rolls between which the scratch ticket passes. From FIGS. 5 and 7, it can be noted that the rollers r2 of the first scraping roll RA1 correspond to the rollers r1 of the first contrast and drawing roll RB1, namely, they are arranged in a specular way. Similarly, the rollers r2 of the second scraping roll RA2 correspond to the rollers r1 of the second contrast and drawing roll RB2, namely, they are arranged in a specular way. From FIGS. 1 and 2, it can be noted that the machine 10 has an entry side A for the scratch ticket to be scratched and an exit side B for the scratched ticket. A first microswitch L1 is mounted on the entry side A and a second microswitch L2 is mounted on the exit side A.

Operation Principles

The machine 10 has an entry side A (FIG. 1), with a plane 1 that serves as a support (FIG. 1), which guides the coupon or ticket 20 for entry into the machine 10 (FIG. 2). Once the ticket has been laid down and pushed inwards, it arrives at the first microswitch L1 (FIG. 1 and FIG. 6), which enables the start of the motors, namely, the drawing motor MT and the scraping motor MR (FIG. 1); so, the ticket is automatically drawn inside the machine 10 by the rotation of the scraping rolls RA1 and RA2 and the contrast and drawing rolls RB1 and RB2, which respectively rotate in the direction M2 and M1, as shown in FIG. 6, so that the ticket 20 is dragged inside the machine 10.

Once the initial portion of the ticket passes over the centre of the second pair of rolls RA2, RB2, the contact of the ticket with the second microswitch L2 (FIG. 1 and FIG. 6) enables the reversal of the direction of rotation of the scraping rolls RA1 and RA2, which now rotate in the opposite direction M3 while the ticket 20 continues its movement due to the contrast and drawing rolls RB1, RB2, and, consequently, the scraping rollers r2 become counter revolving with respect to the movement of the ticket, optimizing their cleaning effect. After scraping, all the powder of the paint remains on the ticket, therefore, for cleaning it without dispersing the powder there is a brush 3 (FIG. 1 and FIG. 2), so the dirt (i.e., paint scrapings) is swept away as the ticket is moving underneath. Once the ticket has completely passed, dirt (i.e., paint scrapings) falls into the storage drawer 4 (FIG. 1) through the slots of the exit plane 6 shaped like a comb (FIG. 2). The second microswitch L2 remains active as long as the ticket 20 passes entirely through the machine, then the second microswitch L2 is disabled, and the mechanism completely stops and the ticket can be taken from the opposite exit side B without the paint that previously covered it.

Some considerations regarding the difficulties for cleaning these coupons or tickets are due to the fact that: (a) not all paints have the same characteristics, (b) paints have different thickness depending on the type of the ticket, (c) sometimes areas to be cleaned are scattered in several places and sometimes they are discontinuous, (d) graphics of tickets are a few hundredths of a millimeter higher than the surface to be scraped, so that a long and hard scraping element fails to scratch the paint perfectly due to higher thickness of the graphics, which should not to be removed, (e) it is necessary to remove the paint without damaging the graphics underneath, and (f) there are several ticket sizes. This means that it is delicate and complex to remove this particular coat of paint precisely and quickly. All these problems have been solved through the simultaneous interaction of two mechanisms, namely, the scraping device R that acts on the graphics to be removed, while the contrast and drawing device T acts on the opposite side of the ticket. The inventive concept is embodied in both of these two devices T and R, in their parts, in their function, and how they interact with each other.

The scraping device R is placed in the upper part of the machine 10, and the contrast and drawing device T is placed in the lower part of the machine 10, so the ticket passes between them, and the two devices T and R are connected through the side frames FS and FI (FIG. 7) by a screw-spring mechanism 2.8 (FIG. 1), which allows their adjustment in order to determine the precise distance for the passage of the ticket 20 and, in the same way, to set the force applied on the ticket through the scraping rolls RA1 and RA2 and the contrast and drawing rolls RT1 and RT2.

Scraping Device R

Figure 3:
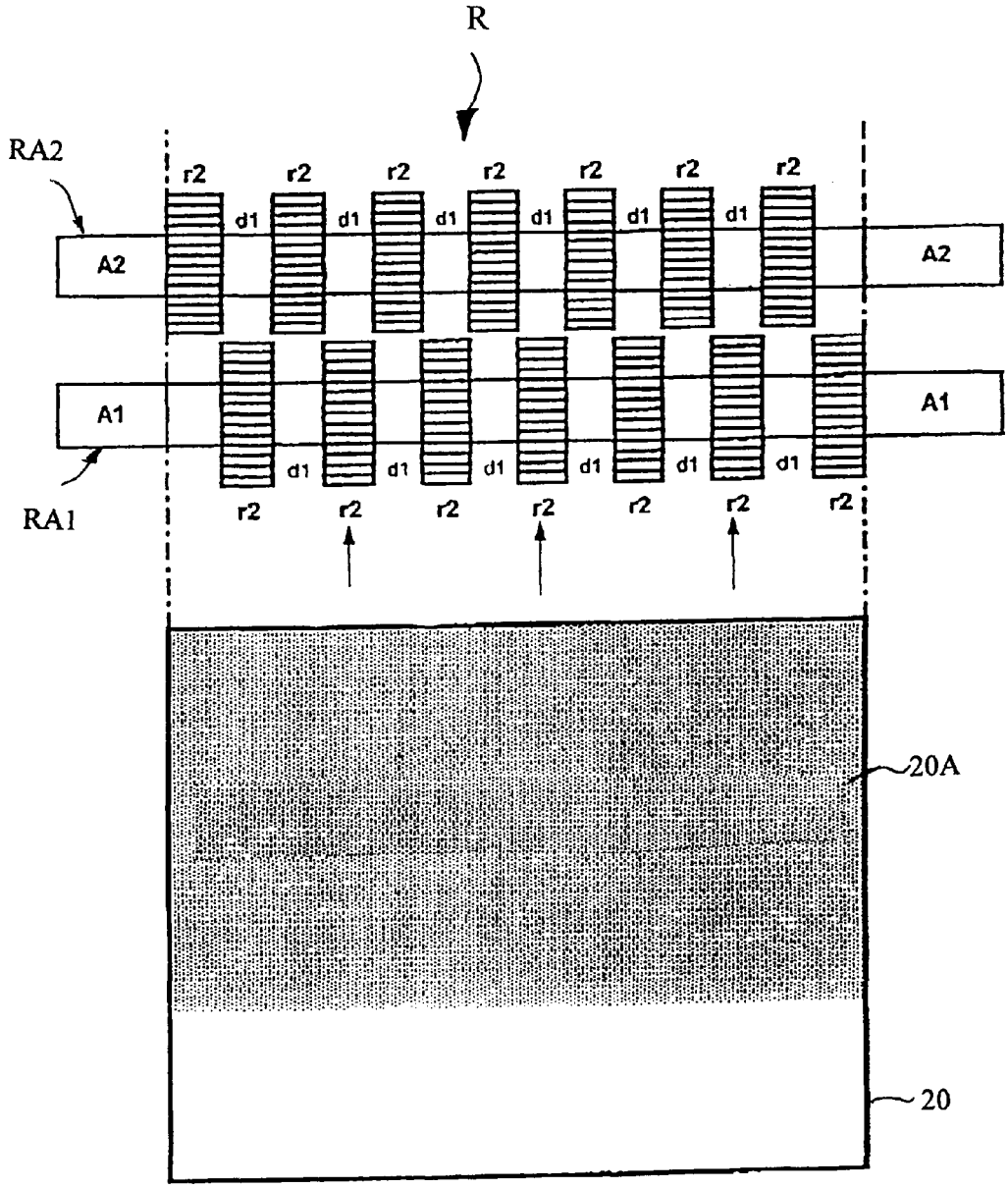
FIG. 3 is a partial top view of the machine of FIG. 1.

Scraping device R consists of two scraping rolls RA1 and RA2 (described above), placed parallel and subsequent to each other (FIG. 3) so as to cover the entire surface to be cleaned 20A, which are operated by the motor MR (FIG. 5), starting with a clockwise rotation M2 and reversing the direction of rotation M3 while the ticket passes. Scraping rolls RA1 and RA2 are composed of toothed metallic rollers r2, mechanically machined on the outside in order to give the tooth a flat and angular form so that, at each passage, they slightly touch the surface of the ticket acting as a scraper for removing the paint, wherein the level of subdivision of the toothed rollers depends on the distance d1 and the width of each roller r2 (FIG. 3) so as to divide the contact area to be scraped into smaller areas. For the same reason, with the same applied (constant) force, the smaller the width of the toothed rollers r2 is, the greater the pressure on the removal points of the paint is. FIG. 3 shows the arrangement of toothed rollers mounted on two shafts A2 and A2 duly spaced by the distance d1, so to ensure coverage of the entire surface to be cleaned (FIG. 3); thus, cleaning is guaranteed even for the smallest areas, and the distribution of rollers r2 covers the maximum area to be cleaned of paint.

Contrast and Drawing Device T (FIG. 4)

The contrast and drawing device T consists of two contrast and drawing rolls RB1 and RB2 (described above) formed by flat rollers r1 in a suitable material for drawing paper, mounted on two shafts B1 and B2, acting on the lower part of the ticket. These rollers r1 have a double function: (a) drawing the ticket, and (b) contrasting the scraping toothed rollers r2, which are above, for this reason, they have the same identical position (specular arrangement) of the above rollers in order to allow them to scrape, wherein the arrangement of the pair of drawing shafts B1, B2 is shown in FIG. 4 while, in FIG. 5, we note that the drawing rollers r1 have the same arrangement, and also the same distance d1 of the toothed rollers r2, which are described above.

In FIG. 5, we note the arrangement of the shaft A1 with its toothed rollers r2, mounted on side frames FS, and the shaft B1 with its flat rollers r1 mounted on the side frames FI, anchored in the base BS and how they interact with each other regarding the entry of the ticket. Also in FIG. 5 we see the motion transmission of the motors MR and MT, which, through the gears IMR and IMT and the gears IAR and IAT, move the shafts A1, A2 and B1, B2. Returning to FIG. 1, we can see the complete arrangement of the shafts A1 and A2 with the respective motor MR, and the shafts B1, B2 with the respective motor MT.

Rotation and Cleaning (FIG. 6).

At the precise moment that the ticket is very close to the first microswitch L1, the motor MT is operated and rotates the contrast and drawing rolls RB1 and RB2 with speed V1 and direction of rotation M1, and the motor MR is operated and rotates the scraping rolls RA1, RA2 with speed V2 (different from V1) and direction of rotation M2; subsequently, the scraping rolls RA1, RA2 and contrast and drawing rolls RB1, RB2 start to rotate and process the ticket 20. At the precise moment the toothed rollers r2 come in contact with the surface of the ticket, they begin the cleaning operation scraping off the removable paint without altering the graphics, which are not to be removed. The effect mentioned above is obtained by the type of construction of the rollers r2 and the level of distribution of the rollers r2, so as to clean small areas. This process is further optimized when the scraping rolls reverse the direction of rotation M3 as the ticket passes, and this occurs at the precise instant the coupon or ticket comes out from the second pair of rolls RA2, RB2, and operates the microswitch L2, instantly, through a reverser, changing the direction of rotation of the rolls. At this point, the toothed rollers r2 become counter revolving with respect to the forward direction of the ticket, consequently, their cleaning action is increased; moreover, the ticket always maintain its forward direction due to the unchanged motion of the contrast and drawing rolls RB1 and RB2.

Thanks to the machine of the present invention, the protective film that covers certain tickets, such as scratch tickets, can be quickly and entirely removed. The advantageous feature of having two scraping rolls, each comprising a plurality of rollers, can also be noted. In this way, the effectiveness of the removal of the coating film increases. The reversal of the direction of the scraping rolls RA1 and RA2, when the ticket passes, allows for the effective scraping of the protective film.

Thus, the system, according to the present invention, is a machine made up of an upper scraping device R (FIG. 7) and a lower contrast and drawing device T (FIG. 7), both independent even in motorization, and connected to each other by respective side frames FI and FS (FIG. 7) through a contrast screw and spring system 2,8 (FIG. 1). Both the scraping device R and the contrast and drawing device T are simultaneously operated, so that when the ticket passes between them, the simultaneous interaction of the two devices R and T clean the ticket 20 of its removable paint. It is clear that variants, or modifications, which are functionally or conceptually equivalent, fall within the scope of the present invention. For example, the scraping device R may be placed in the reverse order as those described and depicted above, namely, the scraping device R may be positioned under the contrast and drawing device T.

The invention claimed is:

1. A machine for scratching off the removable paint of scratch tickets, wherein the machine comprises:

(a) a scraping device; and (b) a contrast and drawing device, wherein the scraping device comprises at least one first scraping roll and the contrast and drawing device comprises at least one contrast and drawing roll, wherein the at least one first scraping roll and the first contrast and drawing roll are provided with at least one motor so as both are driven by the at least one motor, wherein the at least one first scraping roll and the at least one first contrast and drawing roll are disposed opposite each other and spaced between each other, so that when a ticket passes between the at least one first scrapping roll and the at least one first contrast and drawing roll, due to a contemporaneous action of the at least one scraping roll and the at least one drawing roll, the removable paint of the ticket is scraped off by the at least one scraping roll and the at least one drawing roll;

wherein the at least one motor includes a first motor and a second motor, wherein said scraping device includes the first motor that rotates said at least one scraping roll and said contrast and drawing device comprises the second motor that rotates said at least one drawing roll.

2. A machine according to claim 1, wherein the scraping device and the contrast and drawing device are connected by an adjustable contrast screw-spring mechanism that enables adjustment of the scraping device with respect to the contrast and drawing device.

3. A machine according to claim 1, wherein the machine further comprises control means of said at least one motor that rotates the at least one first scraping roll, wherein the control means is operable to reverse direction of rotation of the at least one first scraping roll.

4. A machine according to claim 3, wherein the control means reverses direction of rotation of the at least one first scraping roll with respect to a starting direction of rotation when the ticket passes through the machine.

5. A machine according to claim 1, wherein the contrast and drawing device is positioned underneath the scraping device.

6. A machine according to claim 1, wherein the scraping device is positioned underneath the contrast and drawing device.

7. A machine for scratching off the removable paint of scratch tickets, wherein the machine comprises:

(a) a scraping device; and (b) a contrast and drawing device, wherein the scraping device comprises at least one first scraping roll and the contrast and drawing device comprises at least one contrast and drawing roll, wherein the at least one first scraping roll and the first contrast and drawing roll are provided with at least one motor so as both are driven by the at least one motor, wherein the at least one first scraping roll and the at least one first contrast and drawing roll are disposed opposite each other and spaced between each other, so that when a ticket passes between the at least one first scrapping roll and the at least one first contrast and drawing roll, due to a contemporaneous action of the at least one scraping roll and the at least one drawing roll, the removable paint of the ticket is scraped off by the at least one scraping roll and the at least one drawing roll;

wherein the scraping device comprising the at least one first scraping roll includes at least a first scraping roll and a second scraping roll, and said contrast and drawing device comprising the at least one contrast and drawing roll includes at least a first contrast and drawing roll and a second contrast and drawing roll, wherein the at least one first scraping roll is disposed opposite and distanced from the first contrast and drawing roll and the at least one second scraping roll is disposed opposite and distanced from the at least one second contrast and drawing roll, wherein when the ticket passes between the first scraping roll and the second scraping roll and the first contrast drawing roll and the second contrast and drawing roll, then, due to action of both the first scraping roll and the second scraping roll, the removable paint of the ticket is scraped off.

8. A machine according to claim 7, wherein said scraping device comprising the first scraping roll and the second scraping roll is provided with a respective first motor that rotates the first scraping roll and the second scraping roll and said contrast and drawing device comprising the first contrast and drawing roll and the second contrast and drawing roll is provided with a second respective motor that rotates the first contrast and drawing roll and the second contrast and drawing roll, wherein when the ticket passes between said scraping device and contrast and drawing roll so that due to a contemporaneous action, the scraping device and the contrast and drawing roll clean the ticket of the removable paint.

9. A machine according to claim 7, wherein the first scraping roll and the second scraping roll comprise a plurality of toothed scraping rollers spaced between each other and attached respectively to a shaft.

10. A machine according to claim 9, wherein said plurality of toothed scraping rollers are metallic and completely made of a single solid body.

11. A machine according to claim 9, wherein said plurality of toothed scraping rollers are arranged in parallel and subsequent rows.

12. A machine according to claim 9, wherein a plurality of first toothed scraping rollers of said first scraping roll are arranged in a complementary way with a plurality of second toothed scraping rollers of said second scraping roll, so that the plurality of second toothed scraping rollers of said second scraping roll remove any paint not removed by the plurality of first toothed scraping rollers of said first scraping roll and vice versa, so as to completely scrape the paint off the ticket.

13. A machine according to claim 7, wherein said first contrast and drawing roll and said second contrast and drawing roll comprise a plurality of flat rollers spaced between each other and attached to a shaft.

14. A machine according to claim 13, wherein the plurality of flat rollers of said first contrast and drawing roll and of said second contrast and drawing roll are made of a soft material.

15. A machine according to claim 13, wherein arrangement of said plurality of flat rollers is a specular copy of the arrangement of said plurality of toothed scraping rollers.

16. A machine according to claim 7, wherein the machine comprises two independent devices, wherein the two independent devices include the scraping device comprising the first scraping roll and the second scraping roll arranged as a pair of scraping rolls provided with a respective first motor and the contrast and drawing device comprising the first contrast and drawing roll and the second contrast and drawing roll arranged as a pair of contrast and drawing rolls provided with a respective second motor, wherein the two independent devices are joined together by an adjustable contrast screw-spring mechanism so that when the ticket passes between the two independent devices, then due to contemporaneous action by the two independent devices, the two independent devices clean the ticket of the removable paint.

* * * * *